United States Patent [19]

Chuan

[11] Patent Number: 4,942,839

[45] Date of Patent: Jul. 24, 1990

[54] STABILIZED AND FOLDABLE SAFETY INFLATABLE BOAT

[76] Inventor: Chang C. Chuan, No. 32, Ching An Hsing Tswen, Ta Pwu Rd., Chi An Village, Jwei Fang Town, Taipei, Taiwan

[21] Appl. No.: 341,160

[22] Filed: Apr. 21, 1989

[51] Int. Cl.[5] ..... B63B 39/03

[52] U.S. Cl. ..... 114/345; 441/40; 441/66; 114/125

[58] Field of Search ..... 114/345; 441/35, 40, 441/41, 66

[56] References Cited

U.S. PATENT DOCUMENTS

| | | | |
|---|---|---|---|
| 2,223,625 | 12/1940 | Krupp | 114/345 |
| 2,421,679 | 6/1947 | Bingham | 114/345 |
| 2,508,304 | 5/1950 | Sturtevant | 114/345 |
| 2,999,253 | 9/1961 | Lewis | 114/345 |
| 3,056,980 | 10/1962 | Holladay | 441/66 |
| 4,268,930 | 5/1981 | Gillespie | 114/345 |
| 4,528,927 | 7/1985 | Iizuka et al. | 114/345 |
| 4,573,933 | 3/1980 | Cameron | 441/40 |
| 4,692,124 | 9/1987 | Harper | 114/125 |

*Primary Examiner*—Sherman D. Basinger
*Assistant Examiner*—Stephen P. Avila
*Attorney, Agent, or Firm*—Morton J. Rosenberg; David I. Klein

[57] ABSTRACT

A stabilized and foldable safety inflatable boat formed of a synthetic rubber or a plastic material is provided. The housing of the boat being comprised of an upper air holding portion and a lower water holding portion. Both the air holding portion and the water holding portion each include six or more respective independent chambers, each having a respective access for filling the chambers with air or water in a predetermined volume to provide a desired stabilization and provide maximum buoyant force. A mattress portion encircled by the housing also includes independent chambers for selective filling with air and water to provide improved body support. The boat can be deflated and folded for ease of transport.

1 Claim, 4 Drawing Sheets

STABILIZED AND FOLDABLE SAFETY INFLATABLE BOAT

BACKGROUND OF THE INVENTION

The present invention relates to a stabilized and foldable safety inflatable boat, and more particularly to a boat wherein the housing of the boat is comprised of a plurality of independent air and water chambers with each having respective access fitting for filling with air or water.

Regular boats are too expensive and big, requiring costly maintenance. However, the boat is an important water vehicle for use in various hobbies and sports, such as ocean swimming, water skiing, boat racing, ocean fishing or diving.

In order to provide a boat that ordinary people can afford, the instant invention provides a structure wherein the housing is divided into an air holding portion and a water holding portion. Each portion is subdivided into six or more independent chambers, each with a respective access fitting for independent operation, such that the air or water filled in each respective chamber can be adjusted to accommodate different loading and speed requirements.

Further, the boat according to the instant invention is formed of a synthetic rubber or a plastic material and provided in a variety of fadeless colors. The construction being inexpensive and easy to maintain and convenient for transport and storage when deflated and folded.

SUMMARY OF THE INVENTION

A stabilized and foldable safety inflatable boat having an adjustable attitude is provided. The inflatable boat includes a body housing formed of a flexible material composition defining a closed cavity having a boat-like contour. The inflatable boat further includes a buoyancy system formed in an internal upper portion of the body housing for providing flotation of the boat. The buoyancy system includes a plurality of independent closed chambers adapted for filling with a predetermined volume of air. The inflatable boat also includes a stabilization structure formed in an internal lower portion of the body housing for containing ballast to stabilize the boat. The stabilization structure includes a plurality of closed chambers adapted for filling with a selected volume of water. The attitude of the inflatable boat can be adjusted by selectively changing the volume of water in one or more of the plurality of closed chambers. Within an external cavity formed in the body housing there is provided a mattress body for supporting the user of the boat. The mattress body includes a pair of independent chambers disposed in a serpentine-like planar contour, wherein one of the pair of chambers is filled with water and the other filled with air for providing improved support of the user.

DESCRIPTION OF THE PREFERRED EMBODIMENT

Figure 1:
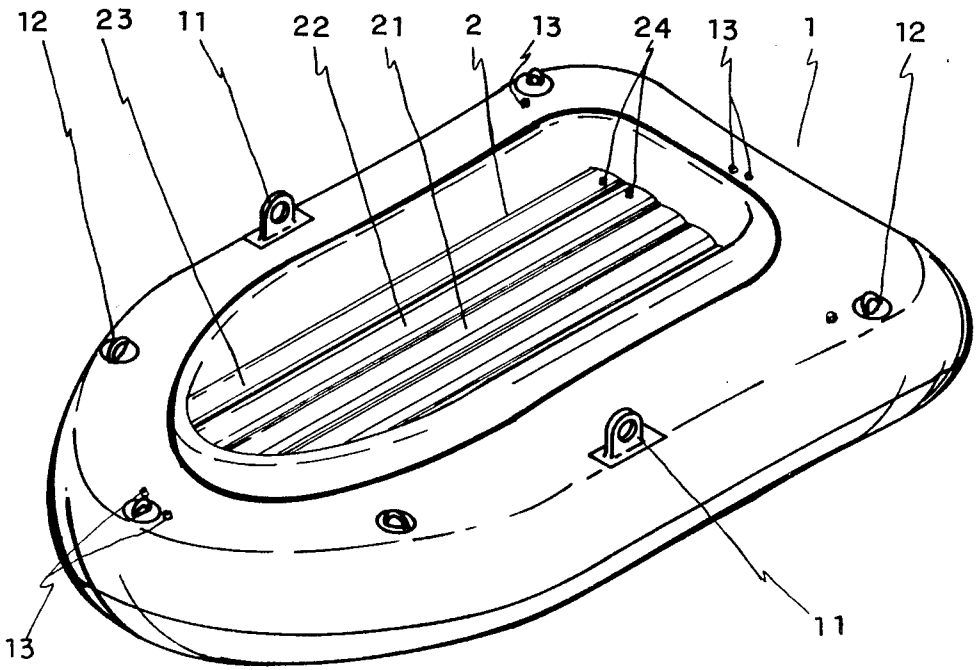
FIG. 1 is a perspective view of a boat embodying the present invention.

The boat according to the present invention, as shown in FIG. 1, comprises a body housing 1 and a mattress body 2. The body housing includes on a top surface, one pair of oarlocks 11, a plurality of symmetrically located rope retaining rings 12 and a plurality of fill valves 13.

The mattress body 2 is formed by a corrugated air mattress 21. However, air mattress 21 is formed by two independent chambers, air chamber 22 and water cabins 23. Each of chambers 22 and 23 include respective access ports 24 for filling and emptying the respective chambers. The two chambers are arranged in a serpentine pattern to provide better support and comfort for the boat user. This compartmentalized structure provides security in that a small tear in the body of the boat will not cause any critical damage.

Figure 2A:
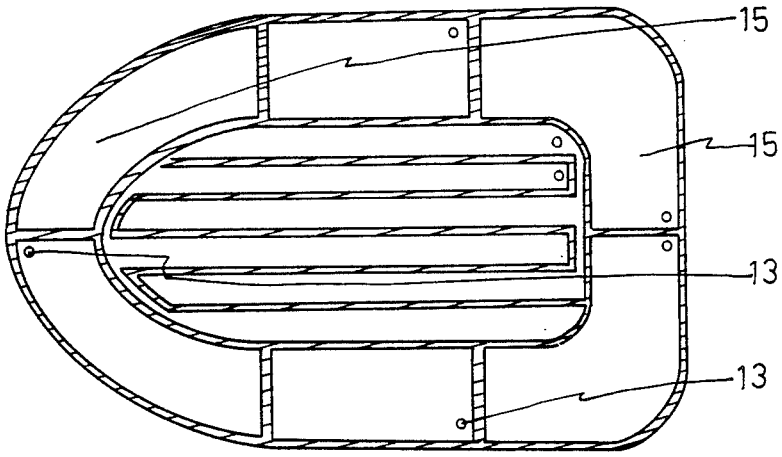
FIGS. 2A–C are cross-sectional views of the preferred embodiment according to the present invention.
Figure 2B:
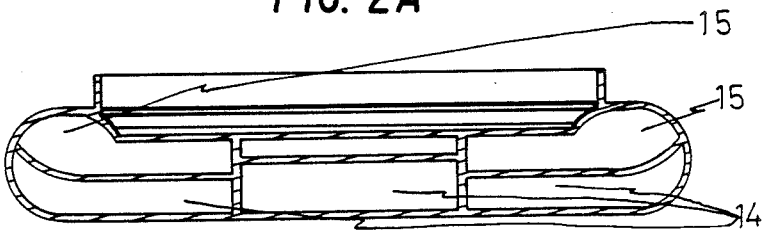
Figure 2C:
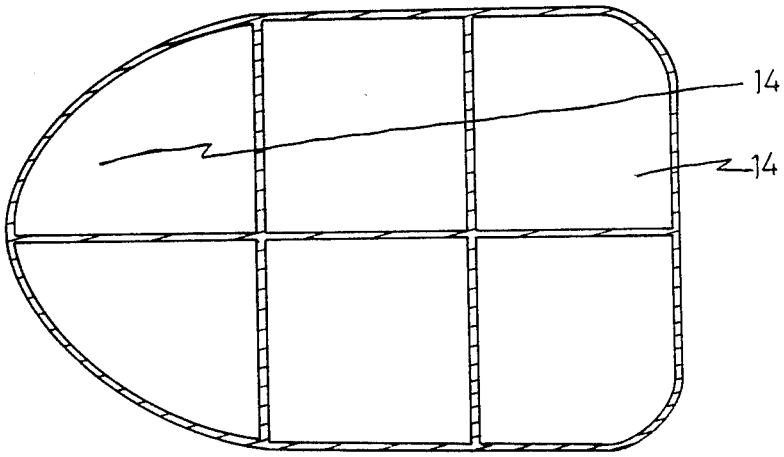

The body housing 1 of the boat, as shown in the sectional views of the preferred embodiment illustrated in FIG. 2, includes a lower water holding portion 14, and an upper air holding portion 15. Both water holding portion 14 and air holding portion 15 are respectively divided into six or more independent chambers. Each independent chamber includes a respective fill valve 13 to provide fluid communication therewith. Fill valve 13 is formed by a fill valve which when closed may be pressed into the chamber space so as to not interfere with operation of the boat, as is well known in the art. In operation, the chambers which form the lower water holding portion 14 are each filled with a selected volume of water to provide stabilization of the boat. The chambers which form the upper air holding portion 15 are each filled with a predetermined volume of air to provide sufficient buoyancy for the boat. Therefore, by means of the aforementioned combination of water chambers and air chambers, the boat so constructed provides an ideal platform for use in water sports. The structure providing a stabilized platform using water as ballast and security from total loss of flotation due to a puncture. Further, the attitude of the boat in the water can be adjusted by the addition or removal of water from selected chambers.

Figure 3A:
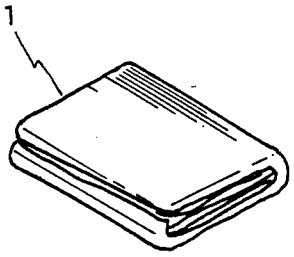
FIG. 3A illustrates the preferred embodiment in a folded condition.
Figure 3B:
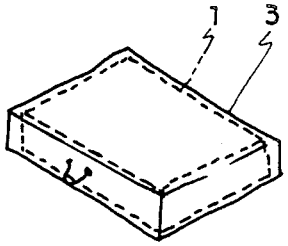
FIG. 3B illustrates the folded invention stored within a carrying case.

The boat can be folded subsequent to deflation, as shown in FIGS. 3A and 3B, for ease of transport and storage. The body housing 1 and the mattress body 2 of the inflatable boat are made of a soft flexible material, such as a synthetic rubber or a plastic material, which can be provided in a variety of colors. When not in use, the boat is folded to minimize its size and packed in a box 3 for ease of storage. In use, the box 3 can also be opened and spread over the upper surface of the mattress body 2 to reinforce the top surface thereof.

Figure 4:
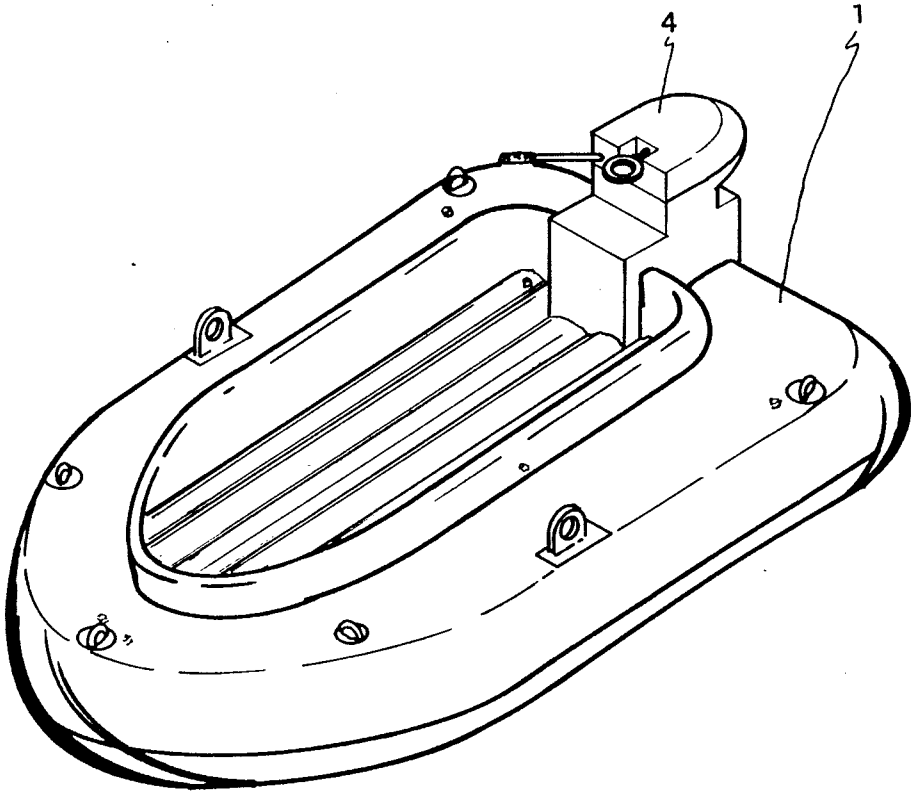
FIG. 4 illustrates a preferred embodiment of the present invention with the attachment of a propulsion unit.

The boat, as shown in FIG. 4, can accommodate a propeller driven propulsion system 4 at the rear portion thereof, for propelling the boat through the water. The boat is adaptable to power driven propulsion by adjustment to the water volume in the lower chambers to provide a selected angle of inclination for the boat as it is accelerated forward by the propulsion system 4.

A stabilized and foldable safety inflatable boat, as described herein, has been constructed to be capable of providing a water holding portion 14 for containing approximately 200 kgs of water to provide ballast for improved stabilization, as compared to an inflatable boat filled only with air. The air holding portion 15 has been constructed to provide a buoyant force of about 500 kgs so as to provide a floating platform for playing water sports which is very stable. Obviously, the number of internal chambers can be adjusted to accommodate different sized boats, and to maximize security and cost objectives.

What is claimed is:

1. A stabilized and foldable safety inflatable boat having an adjustable attitude, comprising:

a body housing formed of a flexible material composition defining a closed cavity having a boat-like contour;

buoyancy means formed in an internal upper portion of said body housing for providing flotation for said boat, said buoyancy means includes a plurality of independent closed chambers adapted for filling with a predetermined volume of air;

stabilization means formed in an internal lower portion of said body housing for containing ballast to stabilize said boat, said stabilization means includes a plurality of closed chambers adapted for filling with a selected volume of water, whereby said attitude is adjusted by selectively changing said volume of water; and, a mattress body means disposed in an external cavity formed in said body housing for supporting a user of said boat, said mattress body means includes a pair of independent chambers disposed in a serpentine-like planar contour, wherein one of said pair of chambers is filled with water and the other filled with air for providing improved support of said user.

* * * * *